US008941548B2

(12) United States Patent
Kashiwagi et al.

(10) Patent No.: US 8,941,548 B2
(45) Date of Patent: Jan. 27, 2015

(54) ANTENNA DEVICE AND ELECTRONIC APPARATUS INCLUDING ANTENNA DEVICE

(75) Inventors: Ippei Kashiwagi, Fuchu (JP); Koichi Sato, Tachikawa (JP); Hiroyuki Hotta, Hamura (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 13/460,350

(22) Filed: Apr. 30, 2012

(65) Prior Publication Data

US 2013/0050036 A1 Feb. 28, 2013

(30) Foreign Application Priority Data

Aug. 30, 2011 (JP) ..... 2011-187569

(51) Int. Cl.

| | |
|---|---|
| ***H01Q 9/00*** | (2006.01) |
| ***H01Q 1/24*** | (2006.01) |
| ***H01Q 5/00*** | (2006.01) |
| ***H01Q 9/42*** | (2006.01) |

(52) U.S. Cl.

CPC ..... *H01Q 1/243* (2013.01); *H01Q 5/0034* (2013.01); *H01Q 5/0058* (2013.01); *H01Q 9/42* (2013.01)

USPC ..... 343/749; 343/702

(58) Field of Classification Search

CPC ..... H01Q 9/30; H01Q 5/0034; H01Q 9/32

USPC ..... 343/749, 702

See application file for complete search history.

(56) References Cited

U.S. PATENT DOCUMENTS

| | | | | |
|---|---|---|---|---|
| 6,738,603 | B1 | 5/2004 | Saito | |
| 7,026,999 | B2 | 4/2006 | Umehara et al. | |
| 7,136,022 | B2 * | 11/2006 | Sato et al. | 343/702 |
| 7,345,637 | B2 | 3/2008 | Mizoguchi et al. | |
| 7,403,160 | B2 | 7/2008 | Chiang et al. | |
| 7,825,859 | B2 | 11/2010 | Teshima | |
| 7,825,861 | B2 | 11/2010 | Sato et al. | |
| 7,885,614 | B2 | 2/2011 | Jedeloo | |
| 7,965,242 | B2 | 6/2011 | Abramov et al. | |

(Continued)

FOREIGN PATENT DOCUMENTS

| | | |
|---|---|---|
| JP | 09-307344 | 11/1997 |
| JP | 1079622 | 3/1998 |

(Continued)

OTHER PUBLICATIONS

Japanese Patent Application No. 2011-187569, First Office Action, mailed Jul. 31, 2012, (with English Translation).

(Continued)

*Primary Examiner* — Dameon E Levi
*Assistant Examiner* — Collin Dawkins
(74) *Attorney, Agent, or Firm* — Blakely, Sokoloff, Taylor & Zafman LLP

(57) ABSTRACT

According to one embodiment; an antenna device according to this embodiment includes the first antenna element formed from a folded monopole element and a capacitor element. The first antenna element has a first end connected to a feeding terminal, a second end connected to the first ground terminal, and a middle portion folded, with a stub being provided between the forward portion and backward portion formed by this folding. The capacitor element is inserted between the stub and the above feeding terminal of the forward portion of the first antenna element.

16 Claims, 17 Drawing Sheets

(56) References Cited

U.S. PATENT DOCUMENTS

| | | | | |
|---|---|---|---|---|
| 2003/0193437 | A1 | 10/2003 | Kangasvieri et al. | |
| 2004/0108957 | A1 | 6/2004 | Umehara et al. | |
| 2005/0094530 | A1 | 5/2005 | Nakagawa et al. | |
| 2005/0153756 | A1 | 7/2005 | Sato et al. | |
| 2007/0164920 | A1 | 7/2007 | Chen | |
| 2007/0229366 | A1 | 10/2007 | Kim et al. | |
| 2008/0169981 | A1* | 7/2008 | Hotta et al. | 343/700 MS |
| 2008/0258992 | A1 | 10/2008 | Tsai et al. | |
| 2009/0027286 | A1 | 1/2009 | Ohishi et al. | |
| 2009/0115388 | A1 | 5/2009 | Miyazaki et al. | |
| 2009/0174611 | A1 | 7/2009 | Schlub et al. | |
| 2009/0231213 | A1 | 9/2009 | Ishimiya | |
| 2010/0026596 | A1 | 2/2010 | Nishio et al. | |
| 2010/0156745 | A1 | 6/2010 | Andrenko et al. | |
| 2010/0194658 | A1* | 8/2010 | Yukimoto et al. | 343/860 |
| 2010/0214181 | A1 | 8/2010 | Ryou et al. | |
| 2010/0321272 | A1* | 12/2010 | Yukimoto et al. | 343/860 |
| 2011/0074638 | A1 | 3/2011 | Gong et al. | |
| 2011/0183633 | A1* | 7/2011 | Ohba et al. | 455/77 |
| 2013/0050057 | A1 | 2/2013 | Hayashi et al. | |

FOREIGN PATENT DOCUMENTS

| | | |
|---|---|---|
| JP | 2003273643 | 9/2003 |
| JP | 2004023369 | 1/2004 |
| JP | 2004-201278 | 7/2004 |
| JP | 2005-203878 | 7/2005 |
| JP | 2005-295493 | 10/2005 |
| JP | 2006-042111 | 2/2006 |
| JP | 2006-101486 | 4/2006 |
| JP | 2006-166994 | 6/2006 |
| JP | 2006-196994 | 7/2006 |
| JP | 2006-279530 | 10/2006 |
| JP | 2007-123982 | 5/2007 |
| JP | 2007-142895 | 6/2007 |
| JP | 2008-28734 | 2/2008 |
| JP | 2008-160411 | 7/2008 |
| JP | 2008-177668 | 7/2008 |
| JP | 2008177668 | 7/2008 |
| JP | 2008-199688 | 8/2008 |
| JP | 2008-271468 | 11/2008 |
| JP | 2008283464 | 11/2008 |
| JP | 2008283493 | 11/2008 |
| JP | 2009-033548 | 2/2009 |
| JP | 2009-246560 | 10/2009 |
| JP | 2010-41071 | 2/2010 |
| JP | 2010-153973 | 7/2010 |
| JP | 2010-526471 | 7/2010 |
| JP | 2011-519542 | 7/2011 |
| WO | WO 2008-013021 | 1/2008 |

OTHER PUBLICATIONS

Japanese Written Opinion and Search Report from PCT/JP2009/064994 dated Aug. 27, 2009.

Japanese Patent Application No. 2010-549969, First Office Action, mailed Jan. 29, 2013, (with English Translation).

PCT Notification of Transmittal of Translation of the International Preliminary Report of Patentability, International Search Report and Written Opinion, Date of mailing Mar. 22, 2012, Applicants Reference No. 09S0467P, International Application No. PCT/JP2009/064994.

Jiunn-Nan Hwang et al: "Isolation Enhancement Between Two Packed Antennas With Coupling Element", IEEE Antennas and Wireless Propagation Letters, IEEE, Piscataway, NJ, US, vol. 10, Jan. 1, 2011, pp. 1263-1266, XP11403146, ISSN: 1536-1225, DOI: 10.1109/LAWP.2011.2174957.

Shuai Zhang et al: "Ultrawideband MIMO/Diversity Antennas With a Tree-Like Structure to Enhance Wideband Isolation", IEEE Antennas and Wireless Propagation Letter, IEEE, Piscataway, NJ, US, vol. 8, Jan. 1, 2009, pp. 1279-1282, XP011331166, ISSN: 1536-1225, DOI: 10.1109/LAWP.2009.2037027.

Andrenko A S et al: "Low Correlation Antenna Design for Diversity Handset Applications", Microwave Conference, 2008. APMC 2008. Asia-Pacific, IEEE, Piscataway, NJ, USA, Dec. 16, 2008, pp. 1-4, XP031637073, ISBN: 978-1-4244-2641-6.

Cui S et al: "Compact dual-Band Monopole Antennas with High Port Isolation", Electronic Letters, The Institution of Engineering and Technology, vol. 47, No. 10, May 12, 2011, pp. 579-580, XP006038874, ISSN: 1350-911X, DOI: 10.1049/EL:20103603.

* cited by examiner

When element is bent

When two or more stubs are provided

When portion near feeding terminal is formed into wide portion

When portion near ground terminal is formed into wide portion

When position of ground terminal is offset

When distal end of folded monopole element is formed into meander shape

When distal end becomes single element from midway position

When portion near feeding terminal is formed into wide portion

When distal end is formed into wide portion

When lumped parameter element is mounted in element

When element is bent

When distal end is formed into wide portion

When midway portion of element is connected to folded element

When distal end is branched into two or more portions

When element is branched near feeding point

When distal end portion of element is formed into meander shape

When proximal end is formed into wide portion

When one or more monopole elements are added

When lumped parameter element is mounted in element

When element is bent

When distal end portion is formed into meander shape

When distal end portion is formed into wide portion

When distal end portion is branched

When one or more passive elements are added

When middle portion is formed into meander shape

When proximal end is formed into wide portion

When distal end portion is branched

When lumped parameter element is mounted in element

When distal end portion is extended

When disposed below folded element

When disposed in same direction as monopole element

When distal end portion is combined with monopole element bent downward

When made to overlap distal end portion of monopole element

ANTENNA DEVICE AND ELECTRONIC APPARATUS INCLUDING ANTENNA DEVICE

CROSS-REFERENCE TO RELATED APPLICATIONS

This application is based upon and claims the benefit of priority from prior Japanese Patent Application No. 2011-187569, filed Aug. 30, 2011, the entire contents of which are incorporated herein by reference.

FIELD

Embodiments described herein relate generally to an antenna device and an electronic apparatus including the antenna device.

BACKGROUND

Recently, the dimensions and weight of the housings of portable electronic apparatuses typified by cellular phones, smart phones, PDAs (Personal Digital Assistants), tablet-type terminals, and navigation terminals have been required to be reduced, from the viewpoint of compactness and lightweightness. Accordingly, demands have arisen for more compact antenna devices. It has also been required to allow a single portable terminal apparatus to communicate with a plurality of radio systems using different frequency bands.

Conventionally, therefore, as disclosed in, for example, patent literature 1, there has been proposed a multifrequency antenna device in which the second antenna element formed from a monopole element is provided at a position close to the feeding point of the first antenna element formed from a folded element with a stub in a direction opposite to the first antenna element.

However, it is difficult to expand the impedance band of the first antenna element of the conventional multifrequency antenna device itself. In order to expand the band, it is necessary to add the third antenna element to couple the first antenna element to the second antenna element. This inevitably increases the size of the antenna device.

BRIEF DESCRIPTION OF THE DRAWINGS

A general architecture that implements the various features of the embodiments will now be described with reference to the drawings. The drawings and the associated descriptions are provided to illustrate the embodiments and not to limit the scope of the invention.

DETAILED DESCRIPTION

Various embodiments will be described hereinafter with reference to the accompanying drawings.

In general, according to one embodiment, an antenna device according to this embodiment includes the first antenna element formed from a folded monopole element and a capacitor element. The first antenna element has a first end connected to a feeding terminal, a second end connected to the first ground terminal, and a middle portion folded, with a stub being provided between the forward portion and backward portion formed by this folding. The capacitor element is inserted between the stub and the above feeding terminal of the forward portion of the first antenna element.

First Embodiment

Figure 1:
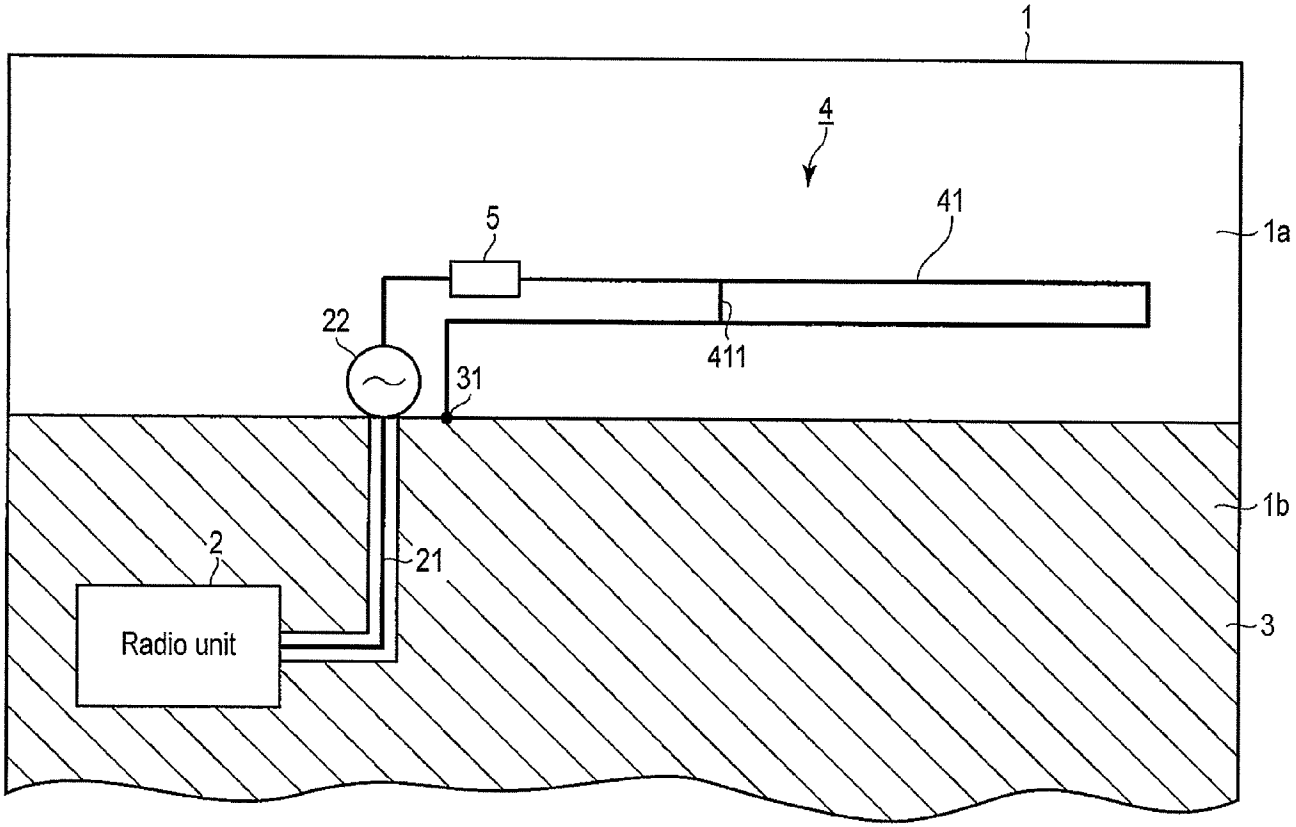
FIG. 1 is a view showing the arrangement of an electronic apparatus including an antenna device according to the first embodiment.

FIG. 1 is a view showing the arrangement of an electronic apparatus including an antenna device according to the first embodiment. This electronic apparatus is formed from a notebook personal computer or television receiver including a radio interface, and includes a printed wiring board 1 accommodated in the housing (not shown).

Note that the electronic apparatus may be a portable terminal such as a cellular phone, smart phone, PDA (Personal Digital Assistant), tablet-type terminal, or navigation terminal instead of a notebook personal computer or television receiver. In addition, the printed wiring board 1 may be one that uses part of a metal housing or a metal member such as a copper foil.

The printed wiring board 1 described above includes a first area 1*a* and a second area 1*b*. An antenna device 4 is provided in the first area 1*a*. A ground pattern 3 is formed in the second area 1*b*. In addition, first and second ground terminals 31 and 32 are provided in the second area 1*b*. Note that a plurality of circuit modules necessary to form the electronic apparatus are mounted on the lower surface side of the printed wiring board 1. The circuit modules include a radio unit 2.

The radio unit 2 has a function of transmitting and receiving radio signals by using the channel frequency assigned to a radio system as a communication target. In addition, in the first area 1*a*, a feeding terminal (feeding point) 22 is provided, and the radio unit 2 is connected to the feeding terminal 22 via a feeding pattern 21.

The antenna device 4 has the following arrangement.

The antenna device 4 includes a folded monopole element 41 as the first antenna element. The folded monopole element 41 is formed from a conductive pattern having a shape obtained by folding the element in a hairpin form at a position almost dividing the entire element into two portions, with one end of the element being connected to the feeding terminal 22, and the other end being connected to the first ground terminal 31. A stub 411 is provided between the forward portion and backward portion formed by folding the above element. More specifically, the stub 411 is connected between an arbitrary point between the feeding terminal 22 and the middle position on the forward portion and an arbitrary point between the first ground terminal 31 and the middle position on the backward portion.

The element length of the folded monopole element 41 with the stub, i.e., the electrical length from the feeding terminal 22 to the first ground terminal 31 through the folding position, is set to nearly ½ a wavelength $\lambda_1$ corresponding to a preset first resonance frequency $f_1$. Note that the first resonance frequency $f_1$ is set to the band (700 MHz to 900 MHz) used by a radio system using LTE (Long Term Evolution). The distance between the feeding terminal 22 and the first ground terminal 31 is set equal to or less than almost ⅕ the wavelength $\lambda_1$ corresponding to the first resonance frequency $f_1$.

In the folded monopole element 41 with the stub described above, a capacitor element 5 is inserted between the stub 411 and the feeding terminal 22 of the forward portion. A capacitance C [pF] of the capacitor element 5 is set within the range of $1/\omega_1 C<250$ [Ω], where $\omega_1$ is an angular frequency corresponding to the first resonance frequency $f_1$. Note however that in the 900-MHz band, in order to maintain a VSWR less than "5", which is a threshold, the capacitance C of the capacitor element 5 needs to be set to about 0.7 pF.

Figure 2:
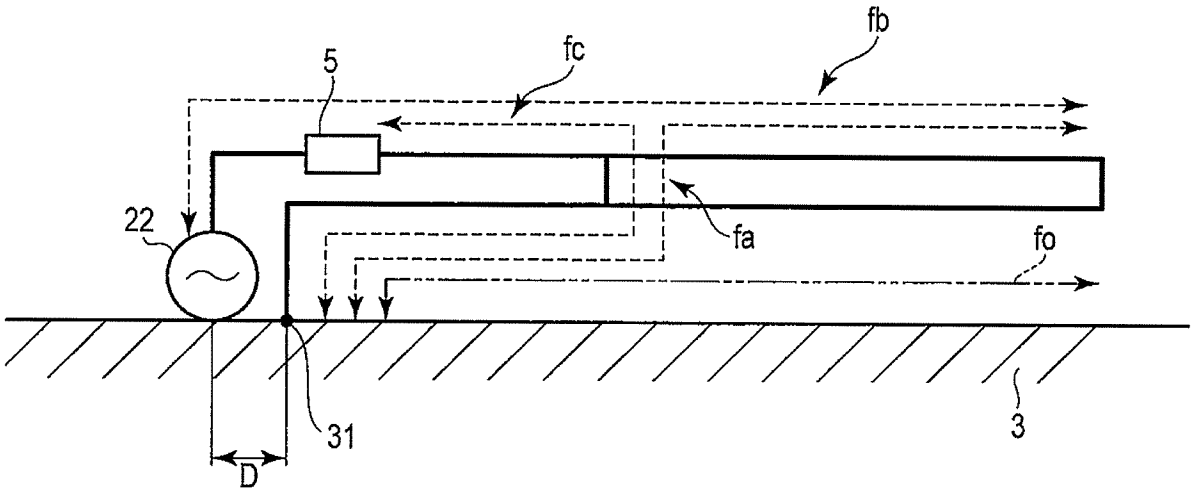
FIG. 2 is a view showing a current distribution in the antenna device shown in FIG. 1.

With this arrangement, as shown in FIG. 2, providing the capacitor element 5 generates, on the folded monopole element 41 with the stub, a first resonance mode fa based on the zone extending from the first ground terminal 31 to the capacitor element 5 through the stub 411, a second resonance mode fb based on the zone extending from the first ground terminal 31 to the folded end through the stub 411, and a third resonance mode fc based on the zone extending from the feeding terminal 22 to the folding position through the capacitor element 5. Using the three resonance modes fa, fb, and fc can expand the impedance band of the antenna device.

Figure 3:
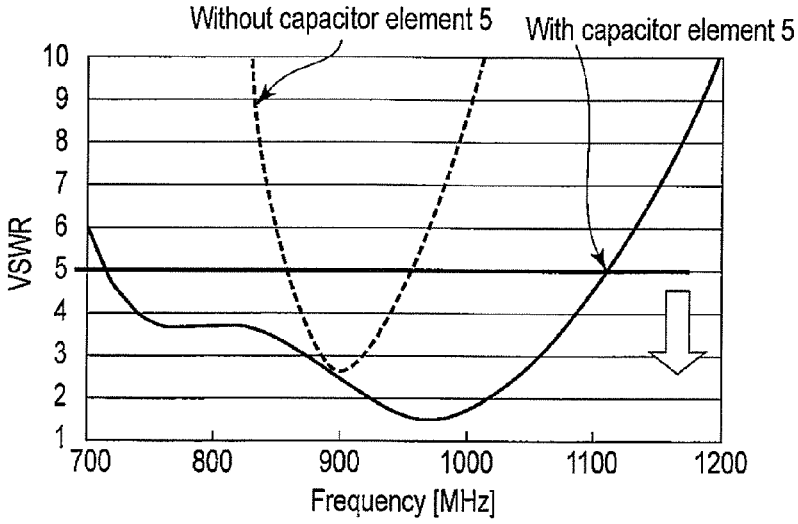
FIG. 3 is a graph showing the VSWR frequency characteristic of the antenna device shown in FIG. 1 in comparison with that of the device without a capacitor element.
Figure 4:
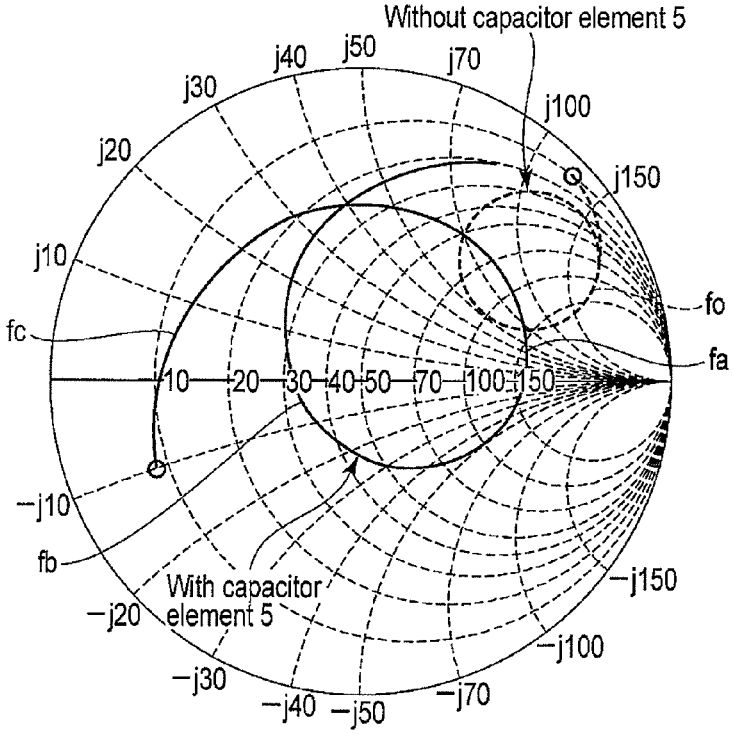
FIG. 4 is a Smith chart showing the impedance characteristic of the antenna device shown in FIG. 1 in comparison with that of the device without a capacitor element.

FIG. 4 is a Smith chart showing the impedance characteristic obtained by the antenna device according to this embodiment in comparison with that obtained by the device without the capacitor element 5. FIG. 3 is a graph showing the frequency characteristic of a voltage standing wave ratio (VSWR) obtained when the three resonance modes fa, fb, and fc described above are combined, in comparison with that obtained without the capacitor element 5. As is obvious from FIG. 3, providing the capacitor element 5 expands the resonance band to the band of 720 MHz to 1,100 MHz.

When the capacitor element 5 is not provided, a resonance mode fo is generated in the zone extending from the first ground terminal 31 of the backward portion to the folded end, but the resonance mode fa is not generated, as shown in FIG. 2. For this reason, the expansion of the resonance band cannot be expected.

Figure 5:
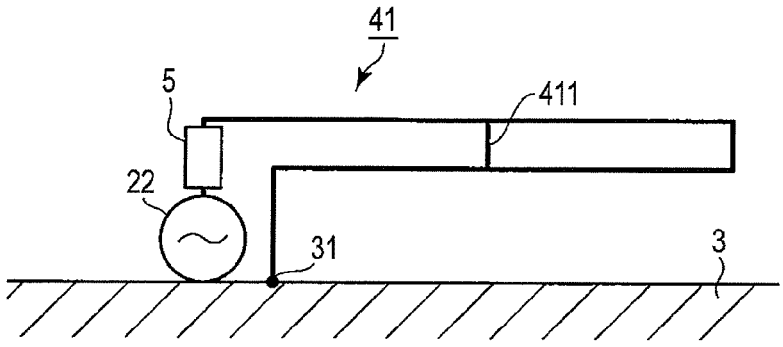
FIG. 5 is a view showing the best installation position of a capacitor element in the antenna device shown in FIG. 1.
Figure 6:
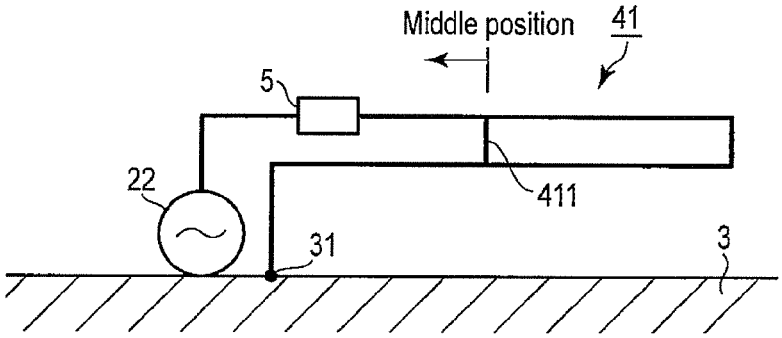
FIG. 6 is a view for explaining the possible installation range of the capacitor element in the antenna device shown in FIG. 1.
Figure 7:
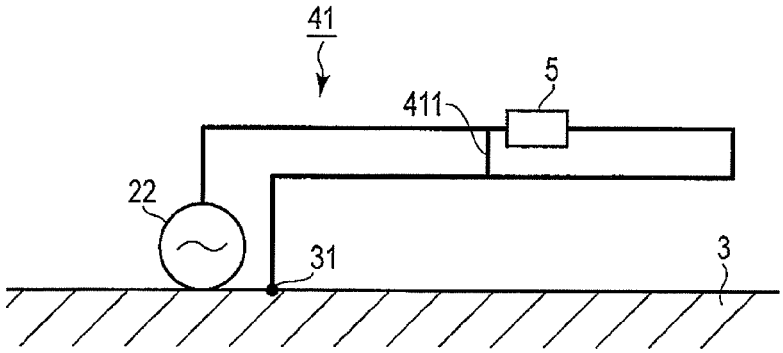
FIG. 7 is a view for explaining an undesirable installation position of the capacitor element in the antenna device shown in FIG. 1.
Figure 8:
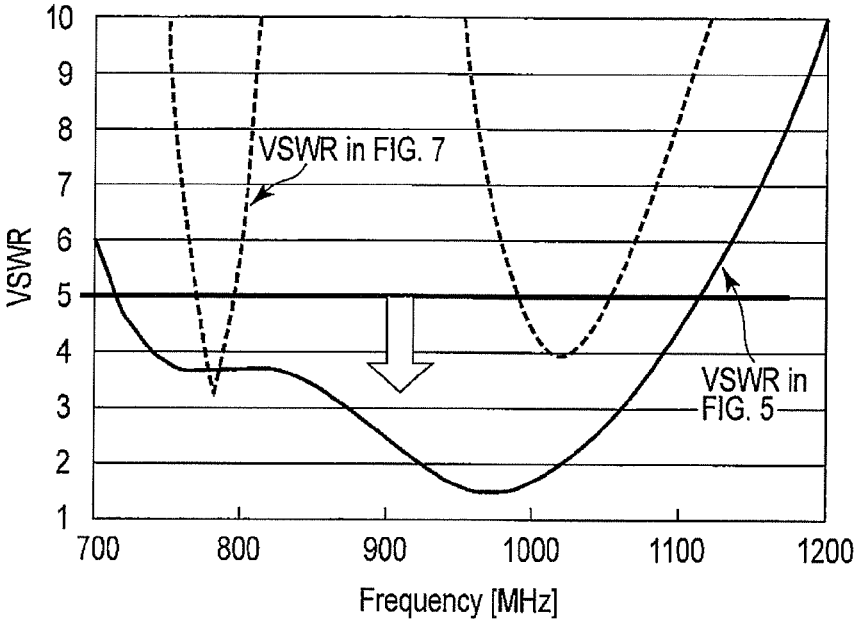
FIG. 8 is a graph showing the VSWR frequency characteristic of the arrangement shown in FIG. 5 in comparison with that of the arrangement shown in FIG. 7.
Figure 9:
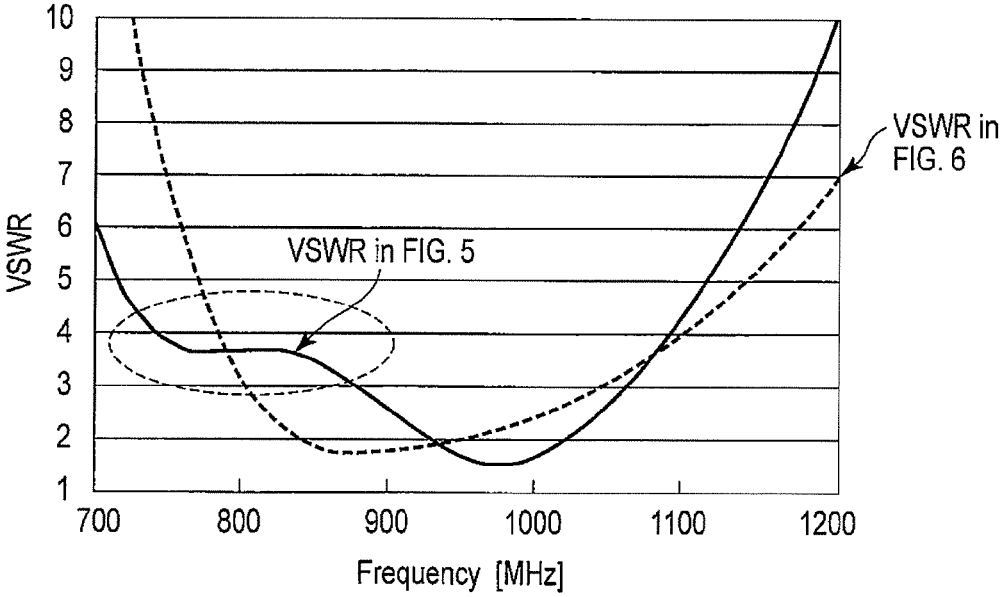
FIG. 9 is a graph showing the VSWR frequency characteristic of the arrangement shown in FIG. 5 in comparison with that of the arrangement shown in FIG. 6.

Note that the resonance band of the antenna device changes in accordance with the installation position of the capacitor element 5. FIGS. 8 and 9 show the VSWR frequency characteristics obtained, respectively, by inserting the capacitor element 5 close to the feeding terminal 22 as shown in FIG. 5, by inserting the capacitor element 5 at an intermediate position in the zone extending from the feeding terminal 22 to the stub 411 as shown in FIG. 6, and by inserting the capacitor element 5 between the stub 411 and the folded end as shown in FIG. 7.

That is, it is possible to expand the resonance band regardless of the position of the capacitor element 5 between the feeding terminal 22 and the stub 411. The closer to the position of the capacitor element 5 to the feeding terminal 22, in particular, the larger the band expansion effect in a low-frequency region of 800 MHz or less. Note that when the capacitor element 5 is inserted between the stub 411 and the folded end, as shown in FIG. 7, no band expansion effect can be obtained, as shown in FIG. 8.

As described in detail above, in the first embodiment, the capacitor element 5 is inserted in the zone extending from the feeding terminal 22 of the folded monopole element 41 with the stub to the stub 411. This can therefore newly generate the resonance mode fa in the zone extending from the first ground terminal 31 of the folded monopole element 41 with the stub to the capacitor element 5 through the stub 411. This makes it possible to expand the resonance band of the antenna device in spite of the very simple arrangement in which the capacitor element 5 is inserted.

A distance D between the first ground terminal 31 and the feeding terminal 22 of the folded monopole element 41 with the stub is set equal to or less than ⅕ the wavelength $\lambda_1$ corresponding to the first resonance frequency $f_1$. This setting allows the folded monopole element 41 with the stub to generate series resonance. This makes it possible to effectively expand the resonance band. When the distance D is set to be long, sufficient series resonance is not generated, resulting in the inability to set the first resonance frequency $f_1$.

Second Embodiment

An antenna device according to the second embodiment is obtained by adding a monopole element 42 to the above folded monopole element 41 with the stub.

Figure 10:
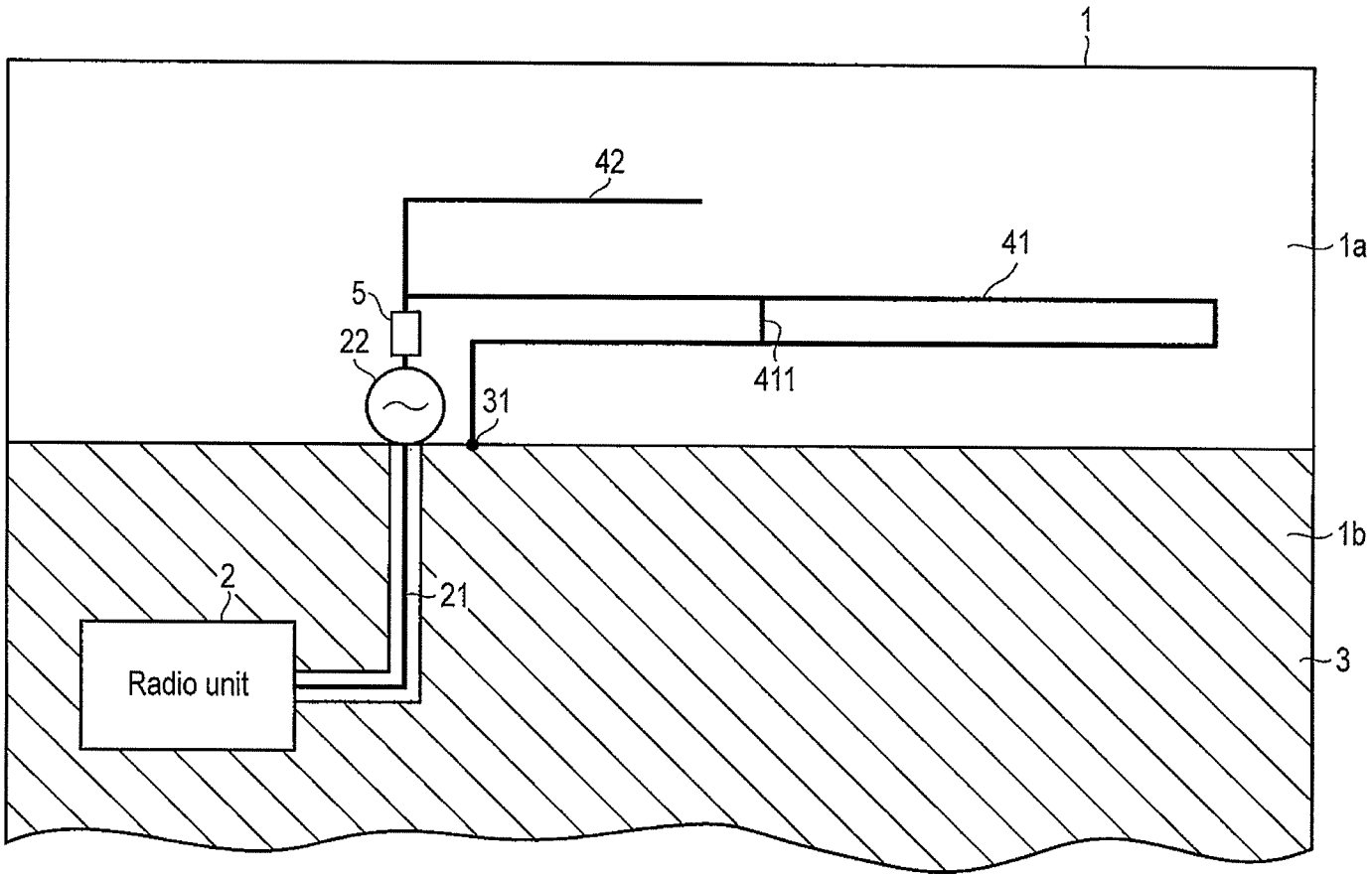
FIG. 10 is a view showing the arrangement of an electronic apparatus including an antenna device according to the second embodiment.

FIG. 10 is a view showing the arrangement of an electronic apparatus including the antenna device according to the second embodiment. The same reference numerals as in FIG. 10 denote the same parts in FIG. 1, and a detailed description of them will be omitted. The antenna device according to the second embodiment includes the folded monopole element 41 as the first antenna element and the monopole element 42 as the second antenna element. Of the elements 41 and 42, the folded monopole element 41 is located closest to a ground pattern 3, and the monopole element 42 is located outside the folded monopole element 41.

The monopole element 42 is formed from an L-shaped conductive pattern. The monopole element 42 has a proximal end connected to the feeding terminal 22 through part of the folded monopole element 41 with the stub and a capacitor element 5, and the second end open. The element length of the monopole element 42, i.e., the length from the feeding terminal 22 to the distal end, is set to a length almost ¼ a wavelength $\lambda_2$ corresponding to a second resonance frequency $f_2$. Note that the second resonance frequency $f_2$ is set, for example, in the band (1.7 GHz to 1.9 GHz) used by a 3G standard radio system.

According to the second embodiment, adding the monopole element 42 to the folded monopole element 41 with the stub allows the monopole element 42 to cover, for example, the band (1.7 GHz to 1.9 GHz) used by a 3G standard radio system as well as allowing the folded monopole element 41 with the stub to cover the band (LTE (Long Term Evolution)) of 700 MHz to 900 MHz.

In addition, since both the folded monopole element 41 with the stub and the monopole element 42 are connected to the feeding terminal 22 via the capacitor element 5, it is possible to adjust the impedance of the monopole element 42 to a value near 50Ω while expanding the resonance band of the folded monopole element 41 with the stub. This can improve the matching of the monopole element 42.

Figure 11:
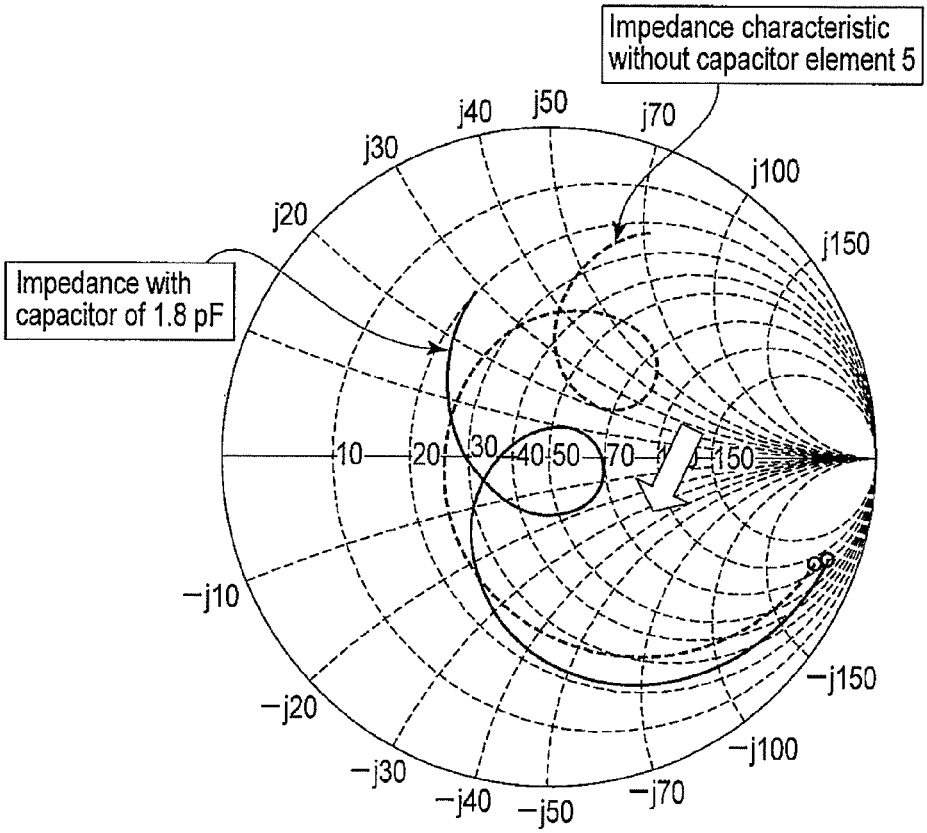
FIG. 11 is a Smith chart showing the impedance characteristic of the antenna device shown in FIG. 10 in comparison with that of the device without a capacitor element.

FIG. 11 is a Smith chart showing the impedance characteristic at the resonance frequency $f_2$ of the monopole element 42 and, more specifically, the impedance characteristic with the capacitor element 5 in comparison with that without the capacitor element 5. As is also obvious from FIG. 11, providing the capacitor element 5 can adjust the impedance of the monopole element 42 to a value near 50 Ω.

Third Embodiment

An antenna device according to the third embodiment is obtained by adding a monopole element 42 to a folded monopole element 41 with a stub and further adding a passive element 43 to the resultant structure.

Figure 12:
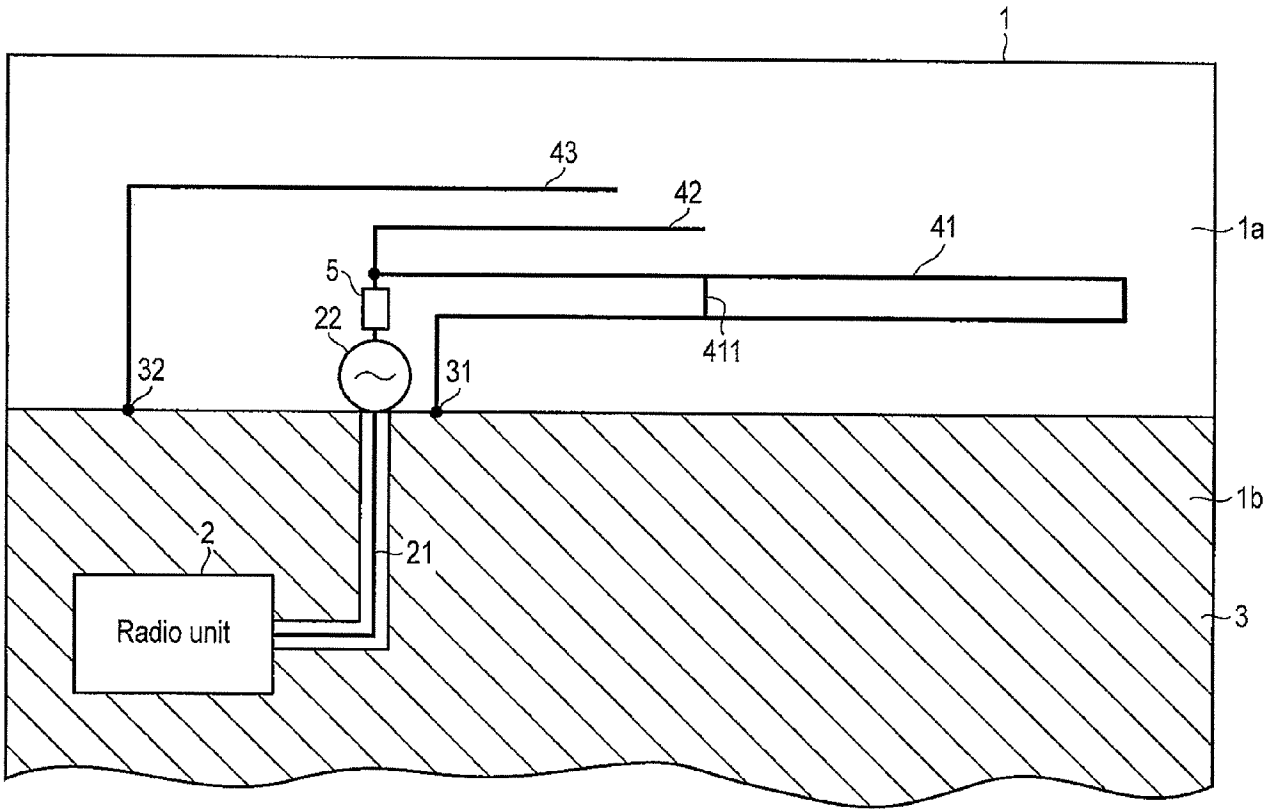
FIG. 12 is a view showing the arrangement of an electronic apparatus including an antenna device according to the third embodiment.

FIG. 12 is a view showing the arrangement of an electronic apparatus including the antenna device according to the third embodiment. The same reference numerals as in FIG. 12 denote the same parts in FIGS. 1 and 10, and a detailed description of them will be omitted.

The antenna device according to the third embodiment includes the folded monopole element 41 as the first antenna element, the monopole element 42 as the second antenna element, and the passive element 43 as the third antenna element. Of these elements 41, 42, and 43, the folded monopole element 41 is located closest to a ground pattern 3, and the monopole element 42 and the passive element 43 are sequentially arranged outside the folded monopole element 41 in the order named in the direction to increase the distance from the ground pattern 3.

The passive element 43 is formed from an L-shaped conductive pattern, and has a proximal end connected to a second ground terminal 32, and a distal end open. The element length of the passive element 43, i.e., the electrical length from the second ground terminal 32 to the distal end, is set to nearly ¼ a wavelength $\lambda_3$ corresponding to a preset third resonance frequency $f_3$. In addition, at least part of the horizontal portion of the passive element 43 which is located on the distal end side is disposed to be parallel with the horizontal portion of the monopole element 42 so as to allow current coupling between them. The third resonance frequency $f_3$ is set in a band near a first resonance frequency $f_1$ or second resonance frequency $f_2$ to expand, for example, the band used by a radio system using the above LTE or the band used by a 3G standard radio system.

The element lengths and relative positions of the folded monopole element 41 with the stub, monopole element 42, and passive element 43 are set to make the first, second, and third resonance frequencies $f_1$, $f_2$, and $f_3$ have the relationship represented by $f_1<f_2<f_3$ or $f_1<f_3<f_2$. This is because the closer to the ground pattern 3, the larger the current and the lower the impedance, and it is desired to generate the lowest resonance frequency in the folded monopole element 41 with the stub.

As described above, in the third embodiment, the folded monopole element 41 with the stub is located closest to the ground pattern 3, and the monopole element 42 and the passive element 43 are sequentially arranged outside the folded monopole element 41 in the order named in the direction to increase the distance from the ground pattern 3. This arrangement generates no parallel resonance between the series resonance bands between the folded monopole element 41 with the stub, the monopole element 42, and the passive element 43, thereby preventing an increase in mismatch loss or a deterioration in radiation efficiency. This prevents interference between the passive element 43, the folded monopole element 41, and the monopole element 42, and hence can further expand the band used by a radio system for LTE or the band used by a 3G standard radio system.

That is, the third embodiment allows the third resonance frequency $f_3$ to be independently set in an arbitrary band near the first or second resonance frequency $f_1$ or $f_2$ without causing interference between the folded monopole element 41 and the monopole element 42 by merely setting the element length of the passive element 43 to an arbitrary length. This can further expand the band of the first or second resonance frequency $f_1$ or $f_2$.

In addition, as in the second embodiment, both the folded monopole element 41 with the stub and the monopole element 42 are connected to the feeding terminal 22 via the capacitor element 5. This can expand the resonance band of the folded monopole element 41 with the stub and adjust the impedance of the monopole element 42 to a value near 50Ω. This makes it possible to improve the matching of the monopole element 42.

Figure 13:
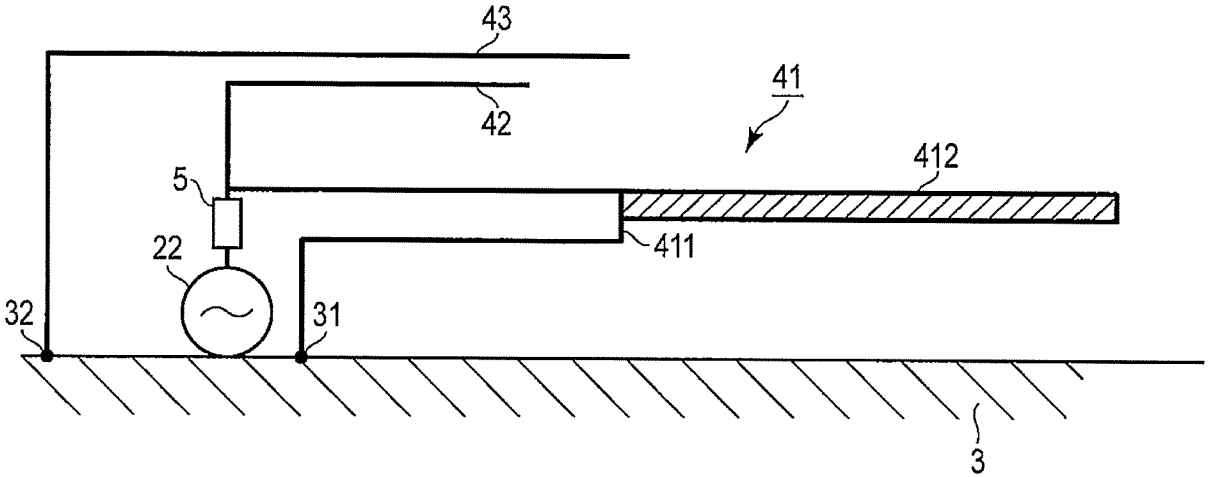
FIG. 13 is a view showing a modification of the antenna device shown in FIG. 10.

The following arrangement is conceivable as a modification of the antenna device according to the third embodiment. FIG. 13 is a view showing the arrangement. Note that the same reference numerals as in FIG. 12 denote the same parts in FIG. 13, and a detailed description of them will be omitted.

The folded monopole element 41 with the stub is configured such that a zone from the installation position of a stub 411 to a folding position is formed by one element 412 having a plate-like shape. Note that the element 412 may have a rod-like shape instead of a plate-like shape.

This arrangement can increase the structural strength of the zone from the stub 411 of the folded monopole element 41 to the folding position. This makes it possible to increase the yield in forming antenna devices.

Fourth Embodiment

An antenna device according to the fourth embodiment is configured such that one side of a ground pattern 3 is formed in a staircase pattern, a feeding cable 23 is wired along a side of the ground pattern 3, and the core of the feeding cable 23 is made to protrude from a side 33 formed in the above staircase pattern into a first area 1*a* so as to be connected to a feeding terminal 22.

Figure 14:
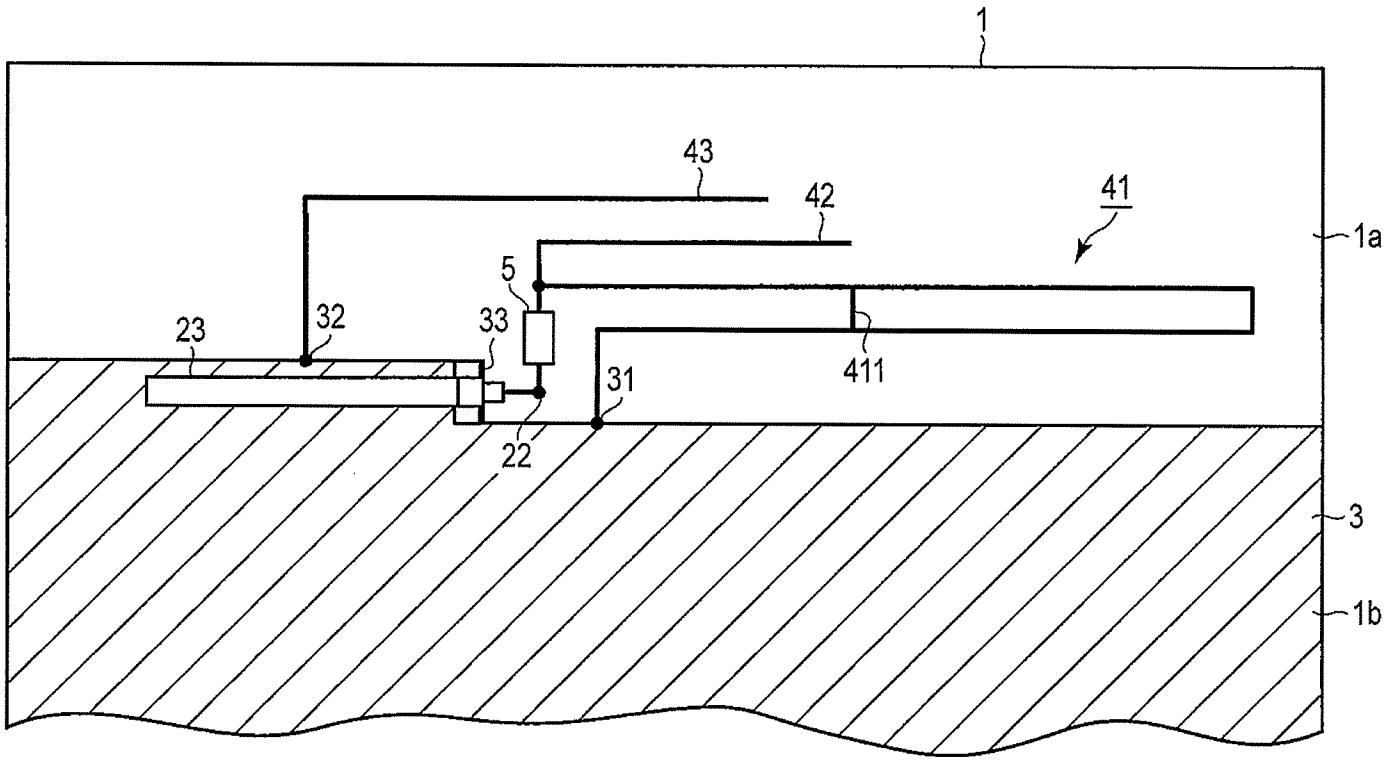
FIG. 14 is a view showing the arrangement of an antenna device according to the fourth embodiment.

FIG. 14 is a view showing the arrangement of the antenna device according to the fourth embodiment. The same reference numerals as in FIG. 12 denote the same parts in FIG. 14, and a detailed description of them will be omitted.

A side of the ground pattern 3 formed on a printed wiring board 1 which is in contact with the first area 1*a* is formed in a staircase pattern (in the form of a crank). The feeding cable 23 is disposed along a side of a portion on the ground pattern 3 which protrudes into the first area 1*a*. The feeding cable 23 is formed from a coaxial cable including a shielded conductive wire 24. The shielded wire is grounded at the ground terminal 33 provided on the ground pattern 3. The feeding terminal 22 is provided at a position on the first area 1*a* which faces the ground terminal 33 of the ground pattern 3. The core of the feeding cable 23 protrudes from the ground terminal 33 into the first area 1*a*, and is connected to the feeding terminal 22. Note that soldering is used for both the connection of the shielded wire to the ground terminal 33 and the connection of the core to the feeding terminal 22.

This arrangement allows to dispose the feeding cable 23 along a side of the ground pattern 3 without bending it into an unnatural shape. This can improve the mounting efficiency of electronic parts per unit area by effectively using the space of the printed wiring board 1, thereby further improving the reliability of the device.

As in the third embodiment, connecting both a folded monopole element 41 with a stub and a monopole element 42 to the feeding terminal 22 via a capacitor element 5 can adjust the impedance of the monopole element 42 to a value near 50Ω while expanding the resonance band of the folded monopole element 41 with the stub. This makes it possible to improve the matching of the monopole element 42.

Other Embodiments

(1) Modification of Folded Monopole Element 41 with

Stub

FIGS. 15A, 15B, 15C, 15D, and 15E and FIGS. 16A, 16B, 16C, 16D, and 16E show various modifications of the folded monopole element 41 with the stub.

Figure 15A:
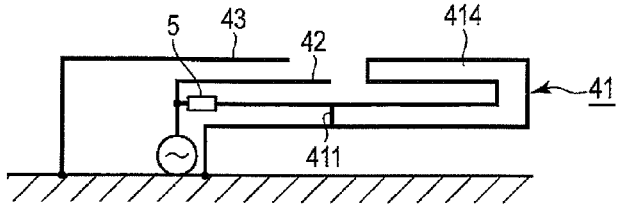
FIGS. 15A, 15B, 15C, 15D, and 15E are views showing the first modification group of a folded monopole element.

The antenna device shown in FIG. 15A is obtained by folding a zone from the installation position of a stub 411 of the folded monopole element 41 with the stub to the folded end in the direction of a monopole element 42. This arrangement can reduce the installation space in the element length direction of the antenna device even when the element length of the folded monopole element 41 with the stub is long.

Figure 15B:
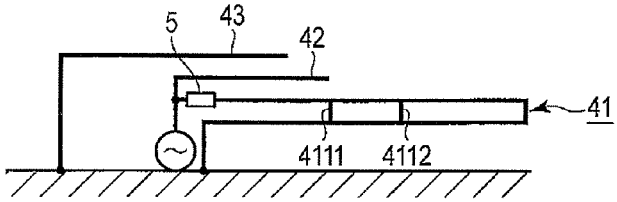

The antenna device shown in FIG. 15B is obtained by providing a plurality of stubs 4111 and 4112 between the forward portion and backward portion formed by folding the folded monopole element 41 with the stub. This arrangement can implement multiple resonance. Note that the number of stubs is not limited to two and may be three or more.

Figure 15C:
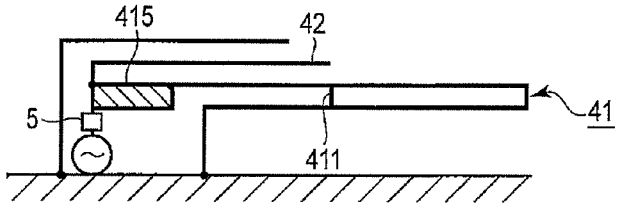

The antenna device shown in FIG. 15C is obtained by forming a portion of the folded monopole element 41 with the stub which is located close to a feeding terminal 22 into a wide portion 415. In this case, the capacitor element 5 is connected between the portion formed into the wide portion and the feeding terminal 22.

Figure 15D:
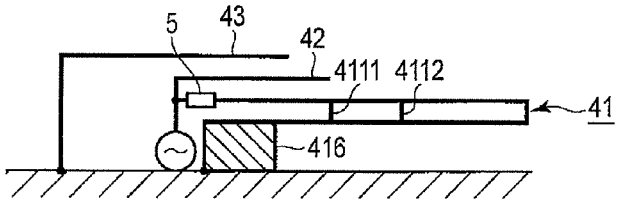

The antenna device shown in FIG. 15D is obtained by forming a portion of the folded monopole element 41 with the stub which is located close to the first ground terminal 31 into a wide portion 416.

Figure 15E:
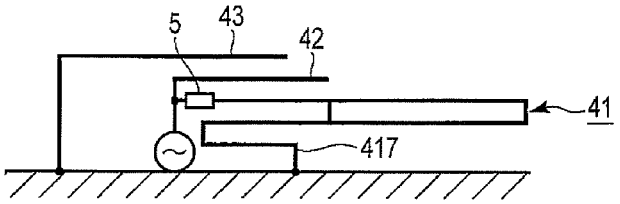

The antenna device shown in FIG. 15E is obtained by offsetting the grounding position of the folded monopole element 41 with the stub with respect to the ground pattern 3, i.e., the position of the first ground terminal 31, in the direction of the distal end of the folded monopole element 41 with the stub.

Figure 16A:
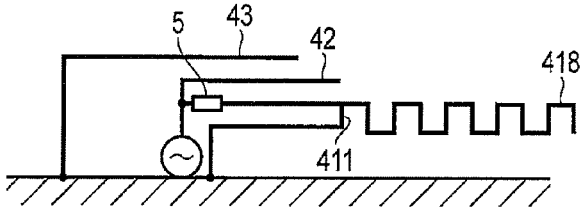
FIGS. 16A, 16B, 16C, 16D, and 16E are views showing the second modification group of the folded monopole element.

The antenna device shown in FIG. 16A is obtained by forming a zone from the installation position of the stub 411 of the folded monopole element 41 with the stub to the folded end by using one element and forming it into a meandering shape.

Figure 16B:
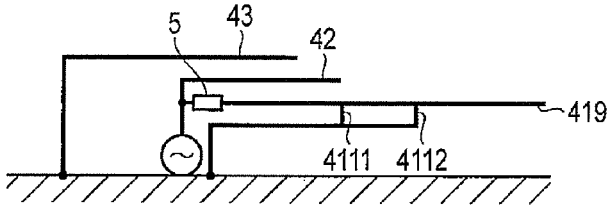

The antenna device shown in FIG. 16B is obtained by providing a plurality of stubs 4111 and 4112 between the forward portion and backward portion formed by folding the folded monopole element 41 with the stub, and forming a zone from the installation position of the stub 4112 to the folded end by using one element.

Figure 16C:
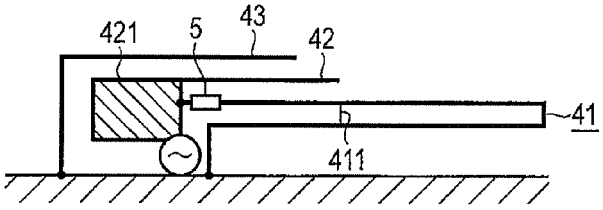

The antenna device shown in FIG. 16C is obtained by forming a portion 421 of the folded monopole element 41 with the stub and of the monopole element 42 which is located close to the feeding terminal 22 into a wide portion.

Figure 16D:
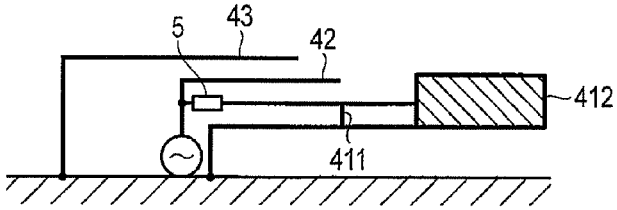

The antenna device shown in FIG. 16D is obtained by forming, by using a plate-like wide element 412, a portion of the zone from the installation position of the stub 411 of the folded monopole element 41 with the stub to the folded end, which portion extends from the middle portion to the distal end portion.

Figure 16E:
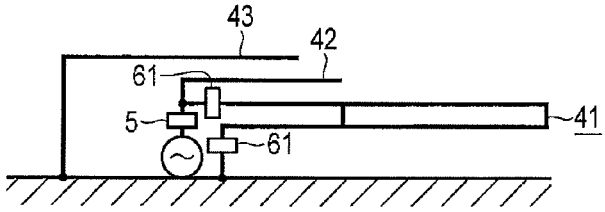

The antenna device shown in FIG. 16E is obtained by inserting the capacitor element 5 in a portion close to the folded monopole element 41 with the stub and the feeding terminal 22 of the monopole element 42, and also inserting lumped parameter elements 61 and 62 in the zone extending from the branching position of the folded monopole element 41 with the stub and the monopole element 42 to the installation position of the stub 411 and in a portion of the folded monopole element 41 with the stub close to the first ground terminal 31. The lumped parameter elements 61 and 62 are formed from inductors, and have a function of increasing the electrical length of the folded monopole element 41 with the stub.

(2) Modifications of Monopole Element 42

FIGS. 17A, 17B, 17C, 17D, and 17E and FIGS. 18A, 18B, 18C, and 18D show various modifications of the monopole element 42.

Figure 17A:
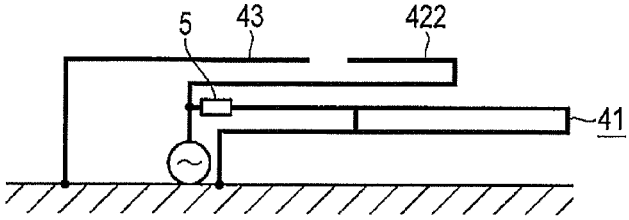
FIGS. 17A, 17B, 17C, 17D, and 17E are views showing the first modification group of a monopole element.

The antenna device shown in FIG. 17A is obtained by folding the distal end portion of the monopole element 42 in the direction of the passive element 43. This can reduce the installation space in the element length direction of the antenna device even when the element length of the monopole element 42 is long.

Figure 17B:
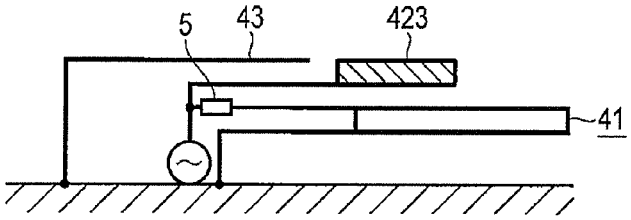

The antenna device shown in FIG. 17B is obtained by forming a distal end portion 423 of the monopole element 42 into a wide portion.

Figure 17C:
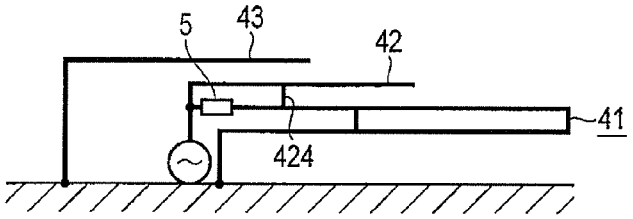

The antenna device shown in FIG. 17C is obtained by connecting the monopole element 42 to the folded monopole element 41 with the stub through a connection element 424 at a position where the monopole elements are parallel with each other.

Figure 17D:
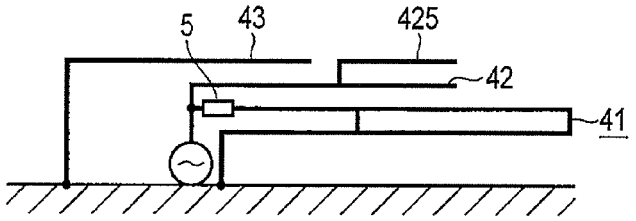

The antenna device shown in FIG. 17D is obtained by branching the distal end portion of the monopole element 42 so as to provide an additional element 425. Although FIG. 17D exemplifies the case in which the device includes one additional element 425, the device may include two or more additional elements.

Figure 17E:
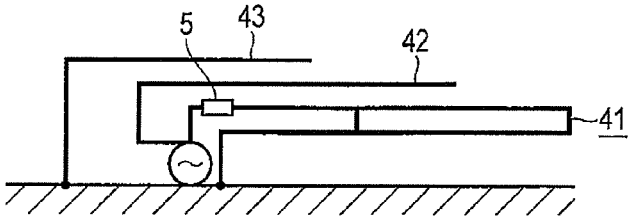

The antenna device shown in FIG. 17E is obtained by branching the monopole element 42 at or close to the feeding terminal 22 instead of branching it midway along the folded monopole element 41 with the stub. That is, in this case, the capacitor element 5 is inserted only between the feeding terminal 22 and the stub of the folded monopole element 41 with the stub without being inserted between the monopole element 42 and the feeding terminal 22.

Figure 18A:
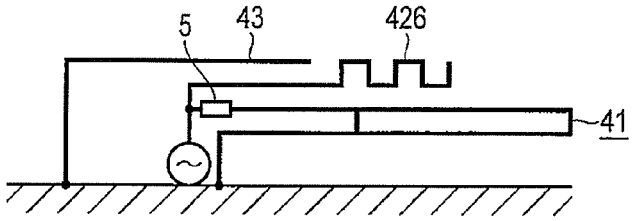
FIGS. 18A, 18B, 18C, and 18D are views showing the second modification group of the monopole element.

The antenna device shown in FIG. 18A is obtained by forming a distal end portion 426 of the monopole element 42 into a meandering shape.

Figure 18B:
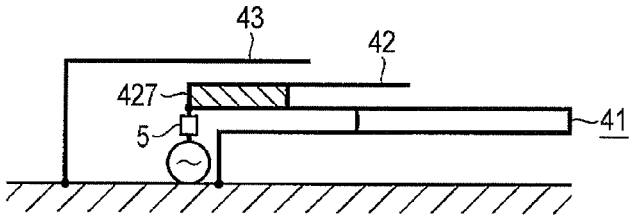

The antenna device shown in FIG. 18B is obtained by forming a connection portion 427 between the monopole element 42 and the folded monopole element 41 with the stub into a wide portion.

Figure 18C:
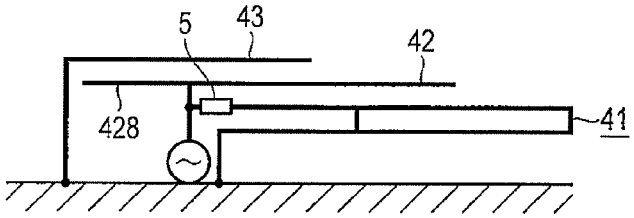

The antenna device shown in FIG. 18C is obtained by providing a second monopole element 428 on the monopole element 42 in a direction opposite to the bending direction of the monopole element 42. Although FIG. 180 exemplifies the case in which the device includes one second monopole element 428, the device may include two or more second monopole elements.

Figure 18D:
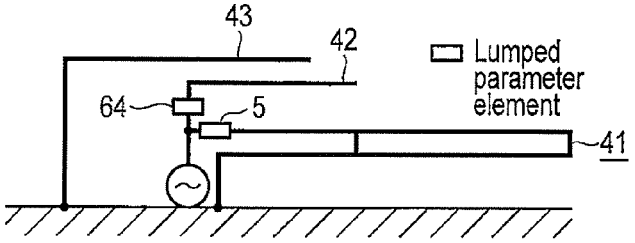

The antenna device shown in FIG. 18D is obtained by inserting a lumped parameter element 64 in the monopole element 42 at a position close to the connection portion between it and the folded monopole element 41 with the stub. The lumped parameter element 64 is formed from an inductor and has a function of increasing the electrical length of the monopole element 42.

(3) Modification of Passive Element 43

FIGS. 19A, 19B, 19C, 19D, and 19E, FIGS. 20A, 20B, 20C, and 20D, and FIGS. 21A, 21B, 21C, 21D, and 21E show various modifications of the passive element 43.

Figure 19A:
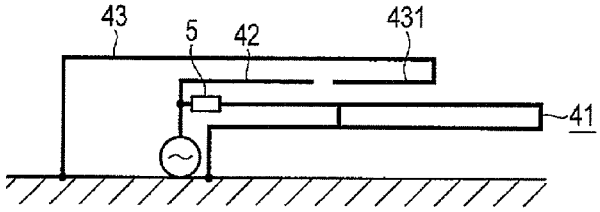
FIGS. 19A, 19B, 19C, 19D, and 19E are views showing the first modification group of a passive element.

The antenna device shown in FIG. 19A is obtained by folding a distal end portion 431 of the passive element 43 in the direction of the monopole element 42.

Figure 19B:
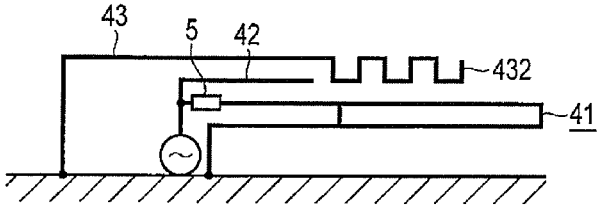

The antenna device shown in FIG. 19B is obtained by forming a distal end portion 432 of the passive element 43 into a meandering shape. This arrangement can reduce the installation space in the element length direction of the antenna device even when the element length of the passive element 43 is long.

Figure 19C:
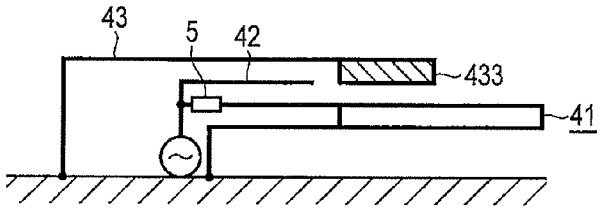

The antenna device shown in FIG. 19C is obtained by forming a distal end portion 433 of the passive element 43 into a wide plate-like shape. Note that the distal end portion 433 may be a rod having a larger diameter than the proximal end portion.

Figure 19D:
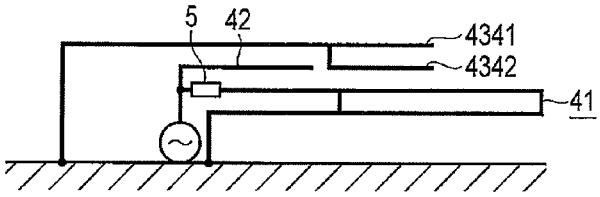

The antenna device shown in FIG. 19D is obtained by branching the distal end portion of the passive element 43 into a plurality of portions so as to provide a plurality of elements 4341 and 4342. Although FIG. 19D exemplifies the case in which the distal end portion is branched into two portions, the distal end portion may be branched into three or more portions.

Figure 19E:
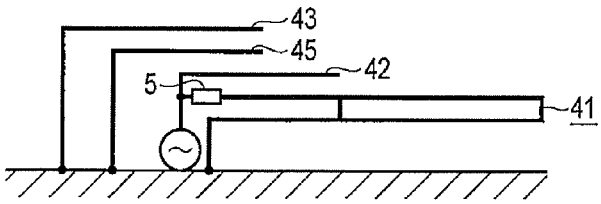

The antenna device shown in FIG. 19E is obtained by providing a plurality of passive elements 43 and 45 between the feeding terminal 22 and a second ground terminal 32.

Figure 20A:
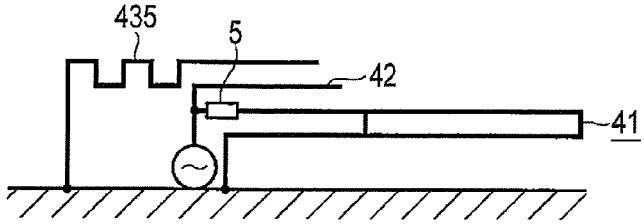
FIGS. 20A, 20B, 20C, and 20D are views showing the second modification group of the passive element.

The antenna device shown in FIG. 20A is obtained by forming a middle portion 435 of the passive element 43 into a meandering shape. This arrangement can reduce the installation space in the element length direction of the antenna device when the element length of the passive element 43 is long.

Figure 20B:
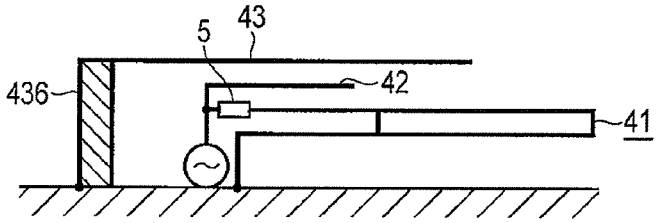

The antenna device shown in FIG. 20B is obtained by forming a proximal end portion 436 of the passive element 43 which is located close to the second ground terminal 32 into a wide portion.

Figure 20C:
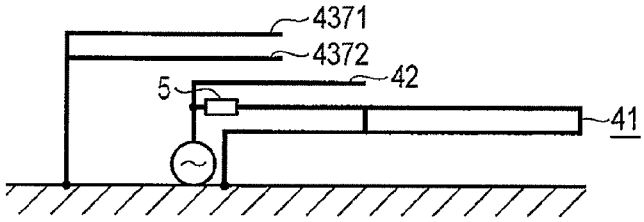

The antenna device shown in FIG. 20C is obtained by branching the passive element 43 at a position where it is bent in an L shape so as to provide a plurality of elements 4371 and 4372. Although FIG. 20C exemplifies the case in which the passive element is branched into the two portions, the element may be branched into three or more portions.

Figure 20D:
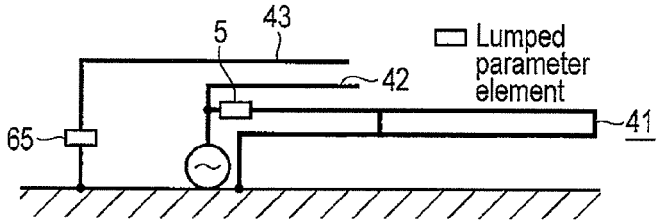

The antenna device shown in FIG. 20D is obtained by inserting a lumped parameter element 65 in the passive element 43 at a position close to the position at which the passive element 43 is connected to the second ground terminal 32. The lumped parameter element 65 is formed from an inductor and has a function of increasing the electrical length of the passive element 43.

Figure 21A:
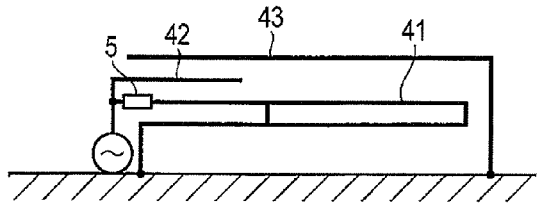
FIGS. 21A, 21B, 21C, 21D, and 21E are views showing the third modification group of the passive element.

The antenna device shown in FIG. 21A is obtained by disposing the passive element 43 having an inverted L shape in a direction opposite to the folded monopole element 41 with the stub and the monopole element 42 while they overlap each other in the vertical direction.

Figure 21B:
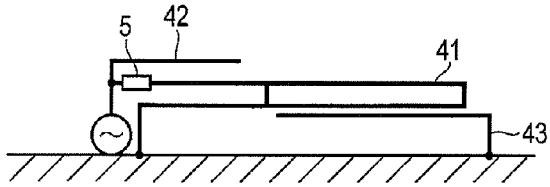

The antenna device shown in FIG. 21B is obtained by disposing the passive element 43 between the folded monopole element 41 with the stub and the ground pattern 3. This arrangement can reduce the dimension of the antenna device in the height direction by reducing the installation space in the stacking direction of the elements 41 to 43.

Figure 21C:
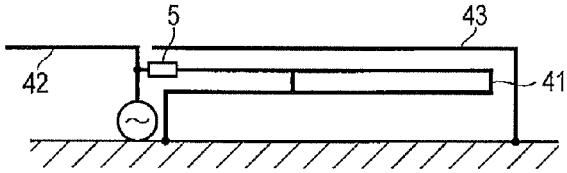

The antenna device shown in FIG. 21C is obtained by disposing the monopole element 42 and the passive element 43 in a direction opposite to the folded monopole element 41 with the stub.

Figure 21D:
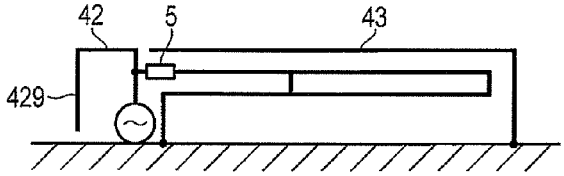

The antenna device shown in FIG. 21D is obtained by bending a distal end portion 429 of the monopole element 42 toward the ground pattern.

Figure 21E:
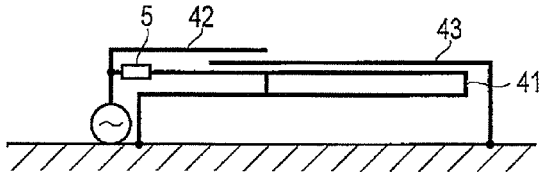

The antenna device shown in FIG. 21E is obtained by disposing the passive element 43 in a direction opposite to the folded monopole element 41 with the stub and the monopole element 42, disposing the elements 41, 42, and 43 in the order named from the side close to the ground pattern 3, and making the distal end portion of the monopole element 42 overlap the distal end portion of the passive element 43.

In addition, the above embodiments can be executed by variously modifying the shapes, installation positions, and sizes of the folded monopole element with the stub, monopole element, and passive element, the type and arrangement of the electronic apparatus, and the like.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An antenna device comprising:

a first antenna element with a stub, the first antenna element being connected between a feeding point and a first ground point, the first antenna element being folded at a folded end to form a forward portion and a backward portion, the forward portion being connected between the feeding point and the folded end and the backward portion being connected between the first ground point and the folded end, and the stub being connected between the forward portion and the backward portion; and a capacitor element connected between the stub and the feeding point in the forward portion.

2. The device of claim 1, wherein when an electrical length of the first antenna element from the feeding point to the first ground point is set to substantially ½ a wavelength $\lambda_1$ corresponding to a preset resonance frequency $f_1$, a distance between the feeding point and the first ground point is set to not more than substantially ⅕ the wavelength $\lambda_1$.

3. The device of claim 1, wherein a capacitance C [pF] of the capacitor element is set within a range of $1/\omega_1 C<250[\Omega]$ where $\omega_1$ is an angular frequency corresponding to the preset resonance frequency $f_1$.

4. The device of claim 1, further comprising a second L-shaped monopole element having a first end connected to an arbitrary point between the stub and the feeding point, and a second end open, and wherein the capacitor element is connected between the feeding point and a connection point of the second L-shaped monopole element and the first antenna element.

5. The device of claim 4, further comprising a third antenna element having a first end connected to a second ground point provided at a position on a side opposite to the first ground point with respect to the feeding point, and a second end open, with at least a portion of the third antenna element being parallel with the second L-shaped monopole element so as to allow capacitive coupling thereto.

6. The device of claim 1, wherein a part of the first antenna element which extends from of the stub to the folded end comprises a rod-like shape or a plate-like shape.

7. The device of claim 1, further comprising:

a printed wiring board including a first area in which the first antenna element and the feeding point are formed and a second area in which a ground pattern having a side partly formed into a substantially staircase pattern and the first ground point are formed; and a feeding cable including a core disposed on the second area so as to protrude from the side formed into the staircase pattern into the first area, the protruding core being connected to the feeding point formed in the first area.

8. The device of claim 1, wherein a resonance band of the antenna device is configured to be expanded based on placement of the capacitor element, a resonance mode is generated in an area extending from the first ground point of the first antenna element with the stub to the capacitor element through the stub.

9. An electronic apparatus comprising:

a radio circuit configured to transmit and receive a radio signal; and an antenna device connected to the radio circuit via a feeding point and a first ground point, the antenna device comprising a first antenna element with a stub, the first antenna element being connected between the feeding point and the first ground point, the first antenna element being folded at a folded end to form a forward portion and a backward portion, the forward portion being connected between the feeding point and the folded end and the backward portion being connected between the first ground point and the folded end, and the stub being connected between the forward portion and the backward portion, and a capacitor element connected between the stub and the feeding point in the forward portion.

10. The apparatus of claim 9, wherein when an electrical length of the first antenna element from the feeding point to the first ground point is set to substantially ½ a wavelength $\lambda_1$ corresponding to a preset resonance frequency $f_1$, a distance between the feeding point and the first ground point is set to not more than substantially ⅕ the wavelength $\lambda_1$.

11. The apparatus of claim 9, wherein a capacitance C [pF] of the capacitor element is set within a range of $1/\omega_1 C<250$ [Ω] where $\omega_1$ is an angular frequency corresponding to the preset resonance frequency $f_1$.

12. The apparatus of claim 9, further comprising a second L-shaped monopole element having a first end connected to an arbitrary point between the stub and the feeding point, and a second end open, and wherein the capacitor element is connected between the feeding point and a connection point of the second L-shaped monopole element and the first antenna element.

13. The apparatus of claim 12, further comprising a third antenna element having a first end connected to a second ground point provided at a position on a side opposite to the first ground point with respect to the feeding point, and a second end open, with at least a portion of the third antenna element being parallel with the second L-shaped monopole element so as to allow capacitive coupling thereto.

14. The apparatus of claim 9, wherein a part of the first antenna element which extends from the stub to the folded end comprises a rod-like shape or a plate-like shape.

15. The apparatus of claim 9, further comprising:

a printed wiring board including a first area in which the first antenna element and the feeding point are formed and a second area in which a ground pattern having a side partly formed into a substantially staircase pattern and the first ground point are formed; and a feeding cable including a core disposed on the second area so as to protrude from the side formed into the staircase pattern into the first area, the protruding core being connected to the feeding point formed in the first area.

16. The apparatus of claim 9, wherein a resonance band of the antenna device is configured to be expanded based on placement of the capacitor element, a resonance mode is generated in an area extending from the first ground point of the first antenna element with the stub to the capacitor element through the stub.

* * * * *